United States Patent [19]

Hankins

[11] 4,221,573

[45] Sep. 9, 1980

[54] ELECTROSTATIC PRECIPITATOR RAPPING MECHANISM

[75] Inventor: Frederick E. Hankins, Raritan Township, Hunterdon County, N.J.

[73] Assignee: Research-Cottrell, Inc., Somerville, N.J.

[21] Appl. No.: 17,902

[22] Filed: Mar. 6, 1979

[51] Int. Cl.[2] ..... B03C 3/76

[52] U.S. Cl. ..... 55/112; 55/300

[58] Field of Search ..... 55/13, 112, 300, 304; 210/413; 209/381, 382; 165/85; 185/6, 7, 32, 33, 35

[56] References Cited

U.S. PATENT DOCUMENTS

| | | | |
|---|---|---|---|
| 333,021 | 12/1885 | Morgan | 55/304 |
| 1,168,543 | 1/1916 | Newhouse | 55/304 |
| 1,433,266 | 10/1922 | Fisher | 55/112 |
| 2,004,494 | 6/1935 | Shoe et al. | 173/89 |
| 2,547,573 | 4/1951 | Gannone | 55/112 |
| 2,550,809 | 5/1951 | Hedberg | 55/112 |
| 2,702,090 | 2/1955 | Brown et al. | 55/112 |

FOREIGN PATENT DOCUMENTS

| | | | |
|---|---|---|---|
| 3653 | 1/1879 | Fed. Rep. of Germany | 55/304 |
| 467410 | 10/1926 | Fed. Rep. of Germany | 55/112 |

*Primary Examiner*—David L. Lacey
*Attorney, Agent, or Firm*—Harold L. Stowell

[57] ABSTRACT

An electrostatic precipitator rapping system of the type which lifts weights and then allows the weights to fall to impact on precipitator elements to impart particulate-dislodging vibration thereto. The system includes a rotating drive shaft and a plurality of individual rapping mechanisms disposed along the drive shaft. Each rapping mechanism includes a driving assembly affixed to the drive shaft and a driven assembly mounted for pivotal movement. A means attached to the driven assembly lifts a weight as the driven assembly pivots in one direction towards a release position and allows the weight to fall to impact as the driven assembly pivots in the other direction towards a resting position. For pivoting and releasing the driven assembly, the driving assembly carries a first engagement member radially spaced from a first axis defined by the drive shaft, the pivotal mounting of the driven assembly in on a second axis offset from the first axis, and the driven assembly carries a second engagement member radially spaced from the second axis for engagement by the first engagement member. The radial spacing of the first engagement member is greater than the distance between the axes and less than the total of the distance between the axes and the radial spacing of the second engagement member such that as the shaft rotates the first engagement member engages said second engagement member at the driven assembly resting position and at positions intermediate the resting and release positions, and said engagement members disengage at the driven assembly release position.

14 Claims, 8 Drawing Figures

ELECTROSTATIC PRECIPITATOR RAPPING MECHANISM

BACKGROUND OF THE INVENTION

The present invention relates to a rapping mechanism and system for an electrostatic precipitator, the rapping system being of the mechanical type and characterized by having the capability of providing relatively high intensity raps if desired.

Electrostatic precipitators are widely employed, particularly among industrial users, for removing particulate from gases. A typical large electrostatic precipitator includes a housing in which banks of vertically extending collecting electrode plates or curtains are disposed, with particulate-laden gas passing through the housing parallel to the plates. The particulate carried by the gas stream is charged to one polarity by means of a corona discharge, and the collecting electrode plates are oppositely charged. The charged particles are therefore electrostatically attracted to the collecting electrodes. Additionally, some particles are attracted to the discharge electrodes which generate the corona discharge.

In order to remove the collected particulate from the electrodes, rapping or vibrating devices are commonly employed. In a large precipitator, there are a plurality of individual rapping devices, each rapping device shocking or vibrating an electrode group comprising one or more electrode plates or discharge electrodes. Collected particulate is dislodged by the vibration and falls by gravity to a sump or the like for removal.

It is an object of the present invention to provide a mechanical rapping system of the type which lifts and then releases weights which then freely fall by gravity impact on precipitator elements mechanically attached to collecting or discharge electrodes to impart mechanical vibration thereto.

It is another object of the invention to provide such a rapping mechanism which is characterized by having long term reliability, while lifting and releasing relatively heavy weights, for example, twenty pound (9.1 kg) weights.

It is still another object of the invention to provide a system including a plurality of individual rapping mechanisms which release their respective weights to effect rapping at different times.

It is still another object of the invention to provide a system including the provision to adjust the height to which the weight is lifted, by simple means and it is still another object of the invention to provide a system that effects a quick release of the driver system when the chosen lift height is attained.

BRIEF SUMMARY OF THE INVENTION

Briefly stated, and in accordance with one aspect of the invention, an electrostatic precipitator rapping system comprises a rotating drive shaft and a plurality of individual rapping mechanisms disposed along the drive shaft. Each of the individual mechanisms provides a rap once each revolution of the drive shaft, which may rotate at approximately 0.5 rpm. Each of the individual rapping mechanisms includes a driving assembly affixed to the drive shaft and rotating therewith. The drive shaft defines, at each of the individual rapping mechanisms, a first axis, and each driving assembly carries a first engagement member radially spaced from the first axis.

Each rapping mechanism additionally includes a driven assembly mounted for pivotal movement on a second axis generally parallel to and offset from the first axis, which offset may be lateral. A means is attached to each driven assembly for lifting a weight as the driven assembly pivots in one direction towards a release position, and which allows the weight to fall to impact on a precipitator element as the driven assembly pivots in the other direction towards a resting position. The means for lifting a weight may comprise a cable having one end attached to the driven assembly and the other end attached to the weight. A semi-circular cable guide defines a portion of the periphery of the driven assembly and receives portions of the cable as the driven assembly rotates towards the release position.

For causing pivotal movement of the driven assembly, a second engagement member is carried by the driven assembly for engagement by the first engagement member, the second engagement member being radially spaced from the second axis. The radial spacing of the first engagement member is greater than the distance between the first and second axes and less than the total of the distance between the axes and the radial spacing of the second engagement member. Accordingly, the first engagement member can engage the second engagement member only at the driven assembly resting position, and at positions intermediate the resting and release positions.

In operation, as the drive shaft rotates carrying the driving assembly therewith, once each revolution the first engagement member engages the second engagement member, causing the driven assembly to pivot and lift the weight. Upon further rotation of the drive shaft and driving assembly, the release position is reached, whereupon the engagement members no longer engage, and the driven assembly pivots back towards the release position, allowing the weight to fall and impact on a precipitator element. The driving assembly continues to rotate around until the first engagement member again engages the second engagement member.

Briefly stated, in accordance with another aspect of the invention, one of the engagement members, preferably the second engagement member carried by the driven assembly, comprises a follower member having a surface portion extending generally radially with respect to the second axis, and mounted securely to the driven assembly. Preferably, the surface portion is flat. The other of the engagement members, preferably the first engagement member carried by the driving assembly, comprises a follower guide member pivotally mounted to the driving assembly and including a surface portion which mates with the follower member surface portion. Preferably, the follower guide surface portion is also flat. Pivotal movement of the follower guide thus accomodates conformal engagement of the engagement members through at least a portion of the range of pivotal movement of the driven assembly. Further, pivotal movement of the follower guide, when the selected lift height is reached, effects the quick release of the driven assembly.

Briefly stated, in accordance with another aspect of the invention, each rapping mechanism, and more particularly each driven assembly, comprises means for rotationally biasing the pivotally mounted follower guide to a position where the surface portions are in approximately conformal engagement upon initial engagement. In the preferred embodiments where the surface portions are flat, the flat portions are approximately parallel upon initial engagement. This biasing means may comprise a tension spring having one end attached to a radially spaced portion of the follower guide.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description taken in conjunction with the drawings in which:

DESCRIPTION OF THE PREFERRED EMBODIMENT

Figure 1:
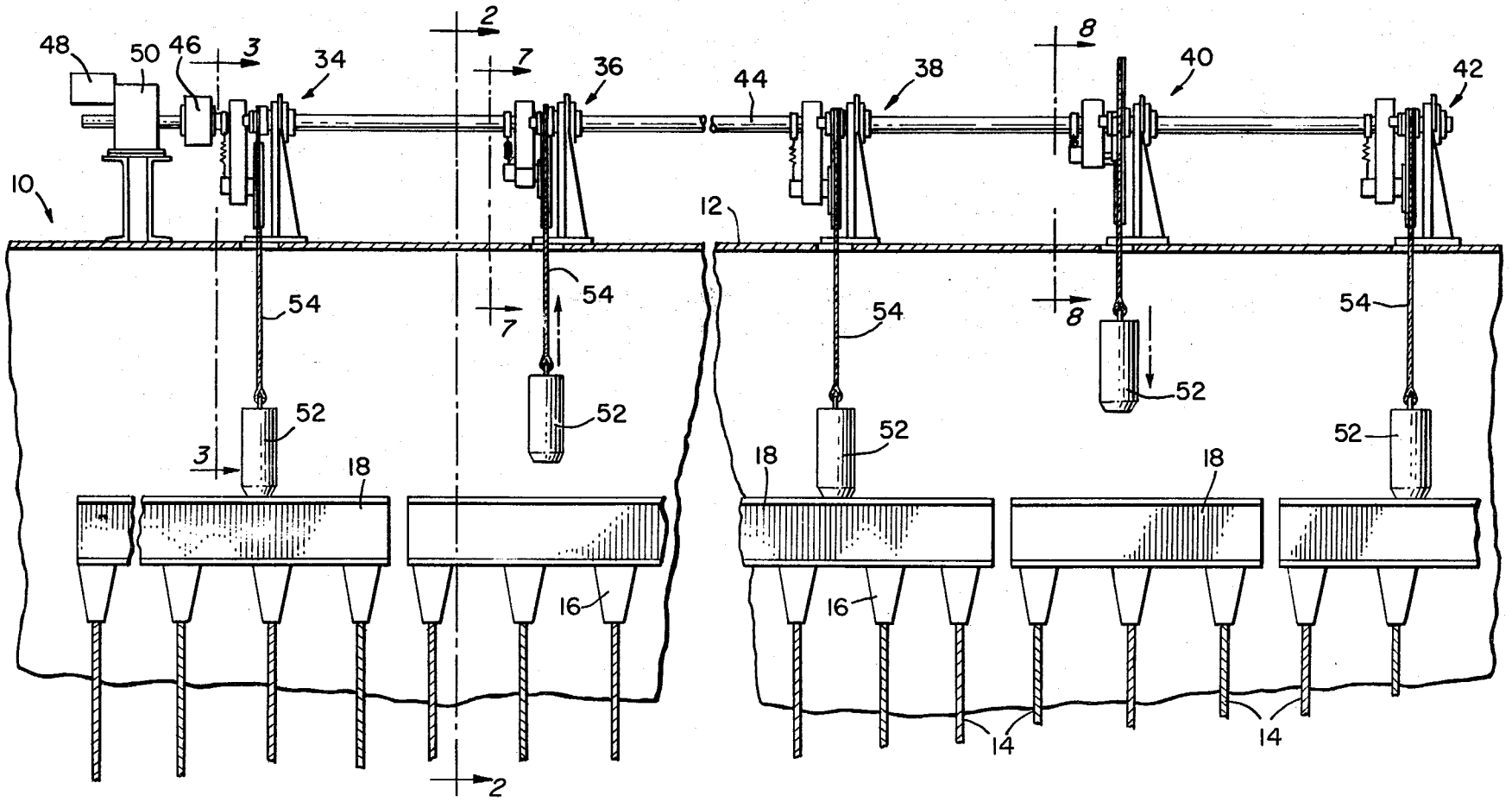
FIG. 1 is an elevational view of a portion of an electrostatic precipitator, showing a front view of each of a plurality of individual rapping mechanisms along a drive shaft.
Figure 2:
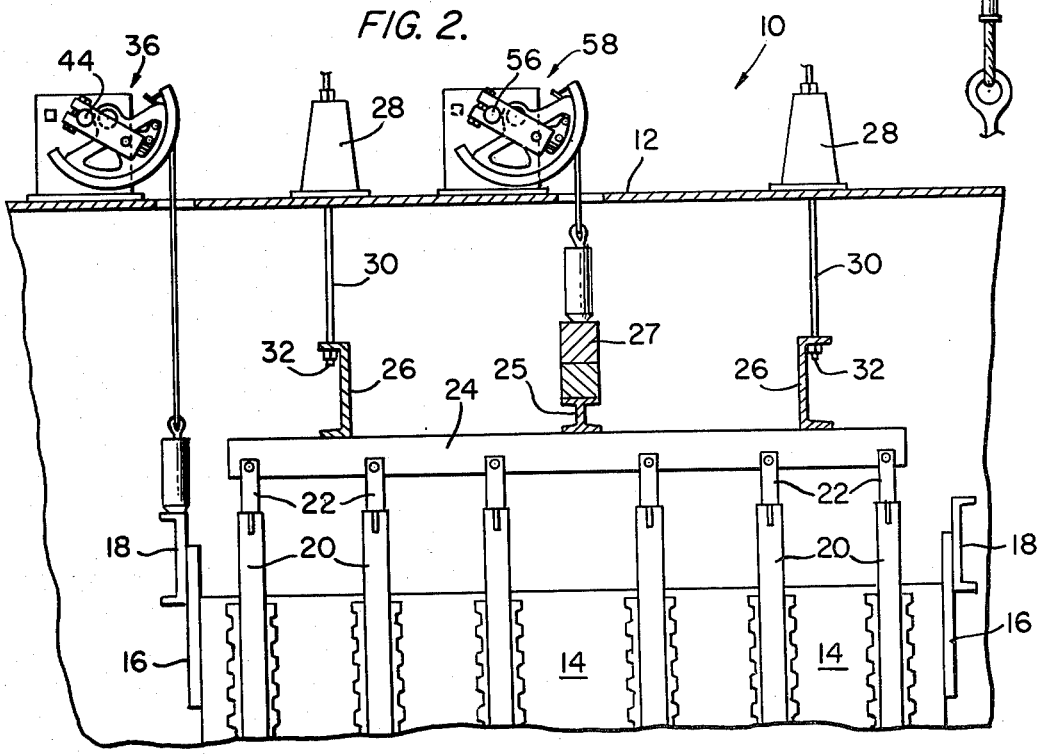
FIG. 2 is a section along line 2—2 of FIG. 1, showing left side elevational views of individual rapping mechanisms along two parallel drive shafts.

Referring first to FIGS. 1 and 2, there is shown an electrostatic precipitator 10 having a top wall 12 and including a plurality of electrically grounded collecting electrode plates 14 supported by conventional hangers 16 in groups from a plurality of individual collecting electrode support beams 18. Conventional means (not shown) are provided to mount the support beams 18 in a manner which permits them to vibrate and transmit vibration through the hangers 16 to the collecting electrode plates 14 when struck by one of the rapping means of the invention.

The electrostatic precipitator 10 additionally includes a plurality of conventional discharge electrodes 20 (FIG. 2 only) supported by hangers 22 from a discharge electrode support beam 24 which in turn is carried by a plurality of discharge electrode cross beams designated 26. Since the discharge electrodes 20 and associated supporting structures are charged to a relatively high negative potential, an insulator 28 surrounds and supports a hanger rod 30 which is bolted at 32 to the discharge electrode cross beam 26. Rapping mechanism of the invention may also be provided for the discharge electrodes 20, in addition to the rapping mechanism, hereinafter described, for the collecting electrodes 14. In FIG. 2, one of the weights of the rapper is shown in association with an anvil beam 25 that enables the rapping blow to be transmitted to a plurality of discharge electrode support beams 24 via an electrical insulator 27 through which the rapping blow is delivered to the charged discharge electrode frame. It will be further appreciated that the structure as thus far described, forming the environment of the present invention, is entirely conventional.

As best seen in FIG. 1, a plurality of individual rapping mechanism 34, 36, 38, 40 and 42 are mounted to the top wall 12 of the electrostatic precipitator 10. The individual rapping mechanisms 34, 36, 38, 40 and 42 are positioned along a common rotating drive shaft 44 which is rotated at a speed of approximately 0.5 rpm through a flexible coupling 46 by an electric motor 48 and a reduction gear 50.

Associated with the individual rapping mechanisms 34, 36, 38, 40 and 42 are weights 52 which are adapted to be lifted by the respective individual rapping mechanism and then released to fall by gravity to impact on a precipitator element, more particularly the collecting electrode support beams 18, to impart vibration thereto. As one example, each weight 52 may be twenty pounds (9.1 kg), having an approximate diameter of 2.25 inches (5.7 cm), and have an approximate length of 18.0 inches (45.72 cm).

The weights 52 are supported by cables 54 extending from the individual rapping mechanisms 34, 36, 38, 40 and 42. The cables 54 may, for example, comprise stainless steel wire rope which is 3/32 inch (2.4 mm) in diameter.

From FIG. 2 it may be seen that a second rotating drive shaft 56 may be provided parallel to the drive shaft 44 and have a second plurality of individual rapping mechanisms disposed therealong, one of which second plurality of rapping mechanisms is designated 58. Although not illustrated, it will be appreciated that the second rotating drive shaft 56 has a suitable driving motor and reduction gear assembly. In a complete system, multiple drive shafts may be provided, each operating a plurality of individual rapping mechanisms.

Figure 3:
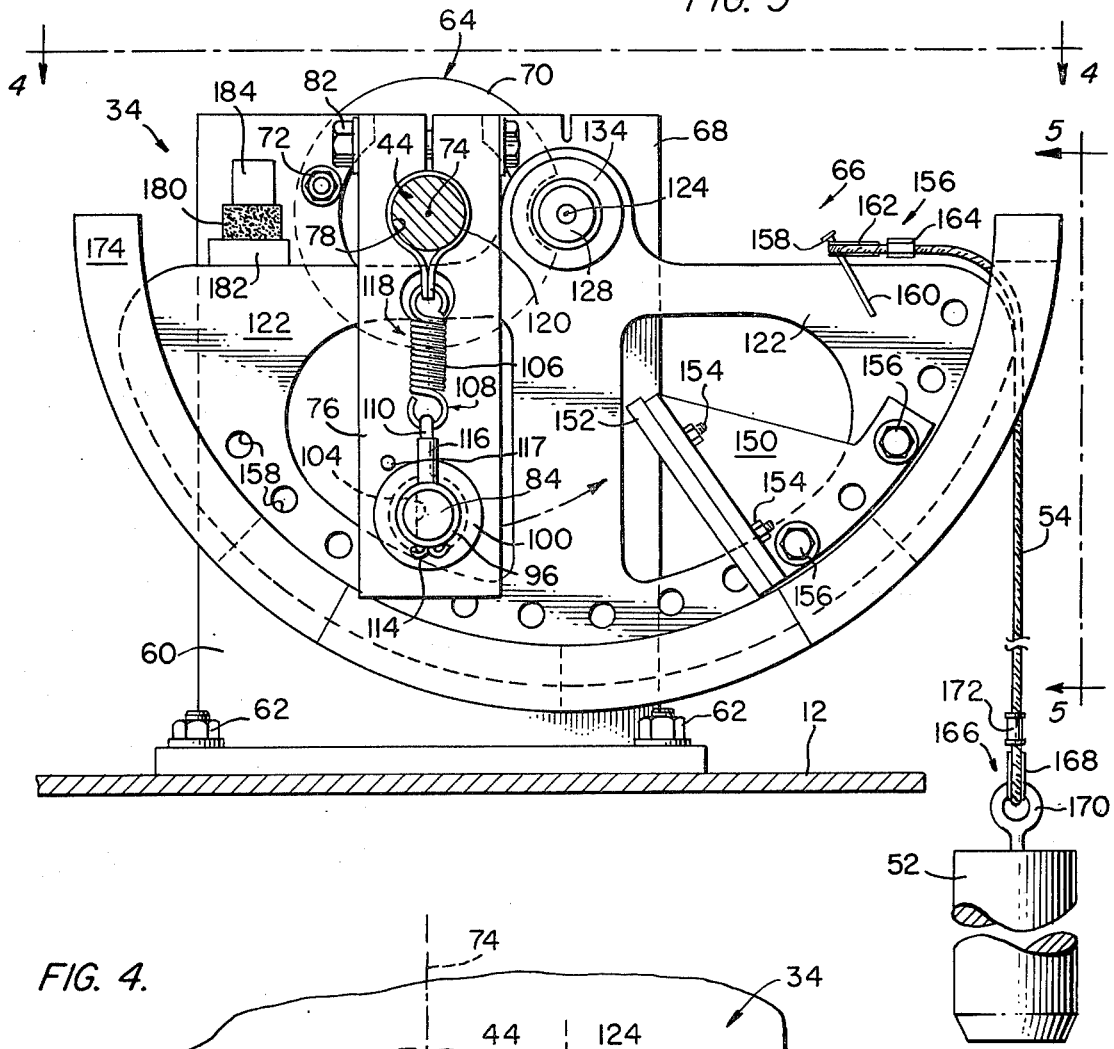
FIG. 3 is a view along line 3—3 of FIG. 1, and is an enlarged side elevational view of an individual rapping mechanism with the driven assembly in a resting position.
Figure 4:
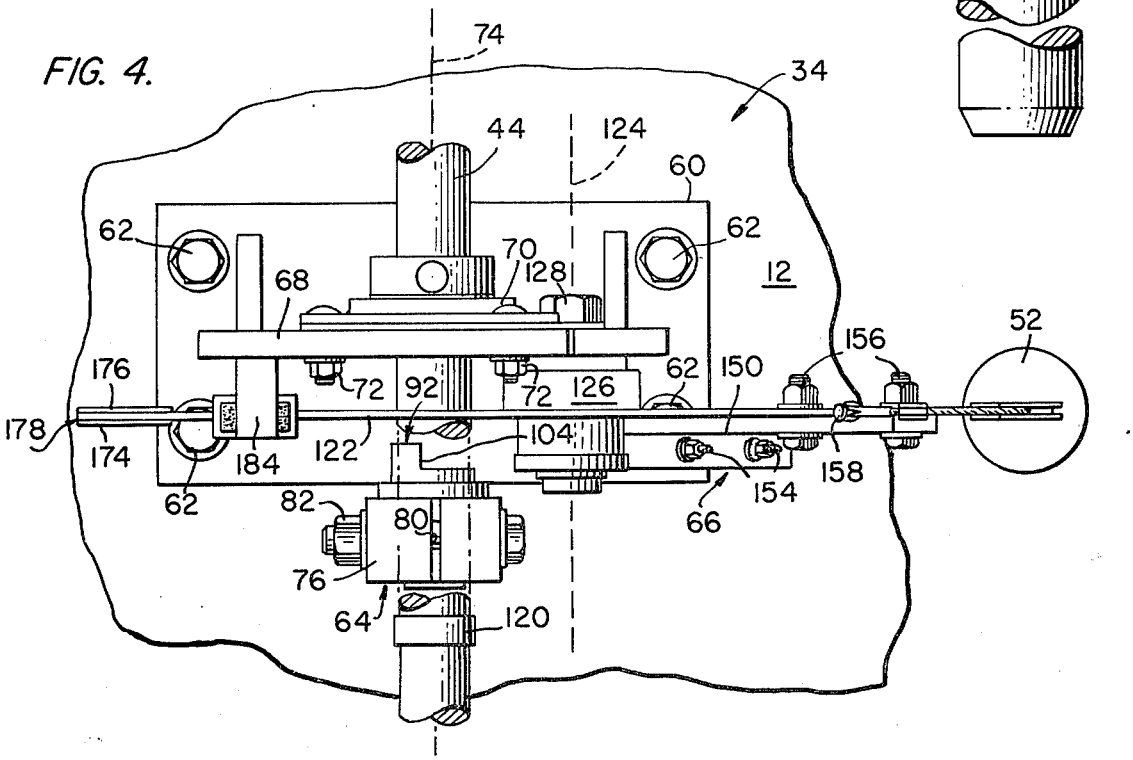
FIG. 4 is a view along line 4—4 of FIG. 3, showing the top of the individual rapping mechanism.
Figure 5:
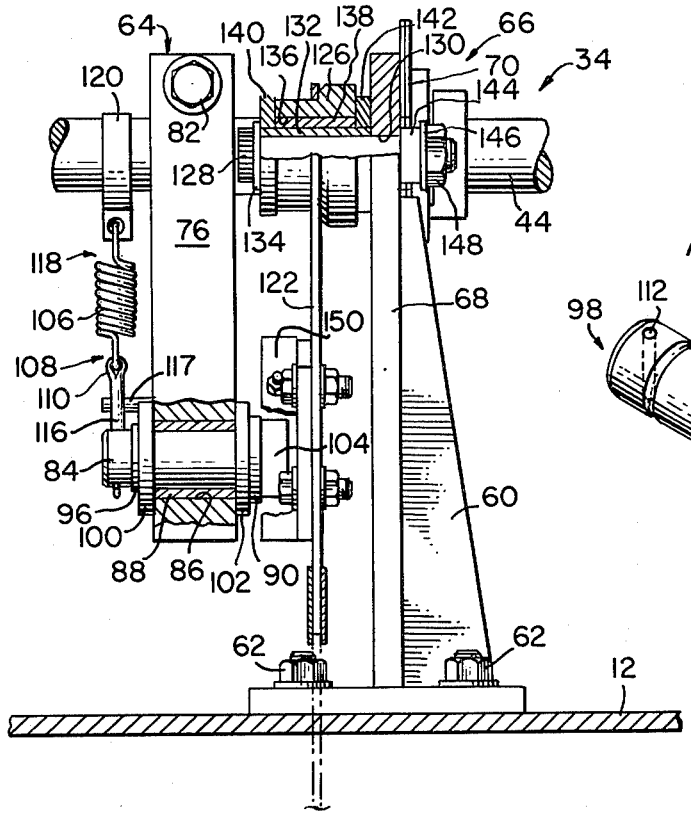
FIG. 5 is a view along line 5—5 of FIG. 3, and is a front elevational view of a rapping mechanism with portions thereof cut away.

Referring now to FIGS. 3, 4 and 5, a representative individual rapping mechanism, specifically the individual rapping mechanism 34 of FIGS. 1 and 2, will be considered in detail. FIG. 3 is a greatly enlarged left side elevational view along the axis of the drive shaft 44; FIG. 5 is a front elevational view; and FIG. 4 is a plan view. The individual rapping mechanism 34 is in a resting condition wherein the associated one of the weights 52 is resting upon its associated one of the collecting electrode support beams 18.

More particularly, the raping mechanism 34 comprises a frame 60 solidly affixed by means of bolts 62 to the top wall 12 of the electrostatic precipitator 10. Movably mounted to the frame 60 are two primary assemblies, specifically a driving assembly, generally designated 64, and a driven assembly, generally designated 66. Additionally, it will be seen that the drive shaft 44 extends through an aperture in an upstanding portion 68 of the frame 60. The drive shaft 44 is supported and guided by a suitable bearing assembly 70 affixed to the frame upstanding portion 68 by means of bolts 72. At the representative mechanism 34, and at each of the other system individual rapping mechanisms, the drive shaft 44 defines a first axis 74.

Considering the driving assembly 64 in detail, firmly affixed to the drive shaft 44 is a driver 76 which comprises an elongated radially extending body having at one end an aperture 78 for receiving the drive shaft 44 and a slot 80 to permit slight elastic deformation for clamping about the drive shaft 44. During assembly, the driver aperture 78 is fitted about the drive shaft 44, then securely clamped by means of a bolt 82. Accordingly, the driver 76 rotates with the drive shaft 44.

Figure 6:
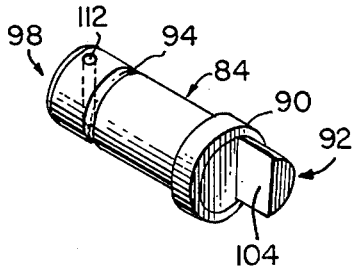
FIG. 6 is a perspective view of a follower guide.

The driving assembly 64 additionally includes a first engagement member radially spaced from the first axis 74. More prticularly, the first engagement member comprises a follower guide 84, which is best seen in FIG. 6. The follower guide 84, is pivotally mounted in an aperture 86 in the driver 76. As may best be seen from FIG. 5, a cylindrical bushing 88 is press-fit into the aperture 86, and the follower guide 84 slipped into the bushing 88. For retaining the follower guide 84 in position, there is provided an annular retaining collar 90 near one end 92 thereof, and an annular recess 94 receiving a retaining ring 96 at the other end 98 thereof. Lastly, a pair of thrust washers 100 and 102 are respectively interposed between the retaining ring 96 and adjacent driver 76 surface, and between the annular retaining collar 90 and the adjacent surface of the driver 76.

At the one end 92 of the follower guide 84 is a surface portion 104, which more particularly is a flat portion 104. As will hereinafter become more apparent, the flat portion 104 of the follower guide or first engagement member 84 meets with a conforming element of the driven assembly 66. The portion of the body of the follower guide 84 behind the flat face 104 will be seen to comprise less than one half of the diameter, which in the first instance provides positive stability upon engagement with the driven member and in the second instance and when rotated 90° effects a discrete clearance of the driven member for rapid release of the driven member.

For rotationally biasing the follower guide 84 to a resting position during periods of non-engagement, a tension spring 106 (FIGS. 3 and 5) has one end 108 secured to the head of a cotter pin 110 which is received in a diametrical bore 112 (FIG. 6) near the end 98 of the follower guide 84. As best seen in FIG 3, the distal ends 114 of the cotter pin 110 are turned outwardly to retain the cotter pin 110 in position. For rigidity, a collar 116 surrounds the end of the cotter pin 110 nearest the tension spring 106. Additionally, a rebound-limiting pin 117 is carried by the driver 76. The other end 118 of the spring 106 is attached to a spring strap 120 which encircles the drive shaft 44.

It will be appreciated that the cotter pin 110, and more particularly the head thereof, comprises a radially spaced portion of the follower guide 84, serving as an extension lever to return the follower guide to the rotational position illustrated in FIG. 3 with respect to the driver 76 under the biasing force of the tension spring 106.

Considering the driven assembly 66 in detail, the driven assembly 66 has a main body portion 122 which may be formed from ten-gauge (3.57 mm) sheet steel. The driven assembly 66, and more particularly the main body 122 thereof, is mounted for pivotal movement on a second axis 124 which is offset from the first axis 74 defined by the rotating drive shaft 44. While the axes 44 and 74 are illustrated as being laterally offset, it will be apparent that this is not essential so long as the geometrical relationship, hereinafter described, of the various elements is maintained.

The details of this pivotal mounting of the driven assembly 66 are best seen in FIG. 5, wherein a hub 126 to which the main body 122 is attached generally pivots about a stripper bolt 128 which passes through an aperture 139 in the upstanding portion 68 of the frame 60.

More particularly, an inner sleeve 132 surrounds the stripper bolt 128 and is tightly held between a shoulder washer 134, which is next to the stripper bolt 128 head, and the frame upstanding portion 68 adjacent the edge of the aperture 130. Press-fit into a bore 136 through the hub 126 is a bushing 138 for rotational sliding engagement with the outer surface of the inner sleeve 132. The resultant assembly comprising the hub 126 and the bushing 138 is axially held in position by a pair of thrust washers 140 and 142 between the respective ends of the hub 126 and the shoulder washer 134 on the one side and the frame upstanding 68 on the other side. Axial compression of the hub 126 and bushing 138 between the thrust washers 140 and 142 which would otherwise prevent free pivotal movement is prevented by the inner sleeve 132. To secure the hub assembly, on the opposite side of the frame upstanding portion 68 is a spacer 144 and a shoulder washer 146 held by a lock nut 148.

As best seen in FIG. 3, a second engagement member, more particularly comprising a follower member 150, is carried by the driven assembly 66, and more particularly by the main body 122 thereof. The follower member 150 is radially spaced from the second axis 124. The face of the follower member 150 comprises a bearing plate 152 affixed by means of bolts 154 having heads (not shown) recessed in the surface of the bearing plate 152. The follower member 150 is firmly attached to the driven assembly main body portion 122 by means of bolts 156 received in apertures 158. For adjustment purposes, it will be seen that a plurality of apertures 158 are provided in the driven assembly main body portion 122, whereby the angular position of the follower member 150 may be selected during initial assembly for proper operation with a particular electrostatic precipitator.

Thus, it will be seen that the adjustment is not a fine "adjustment" but rather permits the selection of the lift height for the weight to a plurality of discrete lift heights typically within the range from 0 inches to 18 inches. The furthermost counterclockwise positioning of the follower 150 is the least lift position and the most clockwise positioning of the follower 150 the maximum lift position.

The surface of the bearing plate 152 of the follower member 150 conforms with the flat surface 104 of the follower guide 84 which comprises an element of the driving assembly 64. In the particular embodiment illustrated, both of these surfaces are flat. It can be seen that the surface portion of the follower member 150 extends generally radially, although not precisely so, with reference to the axis 124 about which the driven assembly 66 pivots.

For lifting the weight 52 as the driven assembly 66 pivots (counter-clockwise in the orientation illustrated in FIG. 3) from the resting position illustrated in FIG. 3, the upper end 156 of the cable 54 is attached to the driven assembly main body portion 122 by means of a pin 158, which may comprise an ordinary nail cut off at the tip end and received in a suitable slot 160 into the driven assembly main body 122 and tack-welded thereto. It will be seen from FIG. 3 that the upper cable end 156 comprises a loop reinforced by a thimble 162 and secured by a wire rope clamp 164. A similar connection at the lower end 166 of the cable 54 comprises a reinforcing thimble 168 engaging an eyebolt 170 received by a threaded bore in the weight 52. A compressed stainless steel sleeve 172 secures the cable loop at the lower end 166. A cable guide comprises a pair of arcuate members 174 and 176 (only arcuate member 174 being visible in FIG. 3) which are tack-welded to opposite sides of the driven assembly main body portion 122 about the periphery thereof. The outer edges of the arcuate members 174 and 176 extend beyond the outer edge of the driven assembly main body portion 122, thereby forming a guide channel 178 for receiving portions of the cable 54.

In order to prevent further reverse rotation (counter-clockwise in the FIG. 3 orientation) of the driven assembly 66 beyond the resting portion illustrated, a rubber stop 180 is adhesively bonded to a steel mounting pad 182 which is welded to a portion of the driven assembly main body portion 122. A stop post 184 is secured to the frame 60 and positioned so as to be engaged by the rubber stop 180 when the driven assembly 66 is in the resting position depicted in FIG. 3.

In the operation of the representative rapping mechanism 34 of FIGS. 3, 4 and 5, as the drive shaft 44 rotates counter-clockwise in the FIG. 3 orientation, it carries with it the driving assembly 64 and, more particularly, the driver 76 and the first engagement member comprising the follower guide 84.

From FIG. 1 it will be seen that the individual rapping mechanisms 34, 36, and 40 are at different operational stages. Specifically, the rapping mechanism 34 is at rest, the rapping mechanism 36 is midway through the weight 52 lifting portion of the cycle, and the mechanism 40 is at the point of release. This staggered operation is accomplished by affixing respective rapping mechanism drivers 76 to the drive shaft 44 at different angular positions. For purposes of illustration herein, the individual rapping mechanisms 36 and 40 are shown herein in FIGS. 7 and 8, with reference numerals unchanged from those employed in FIGS. 3, 4, 5 and 6.

Figure 7:
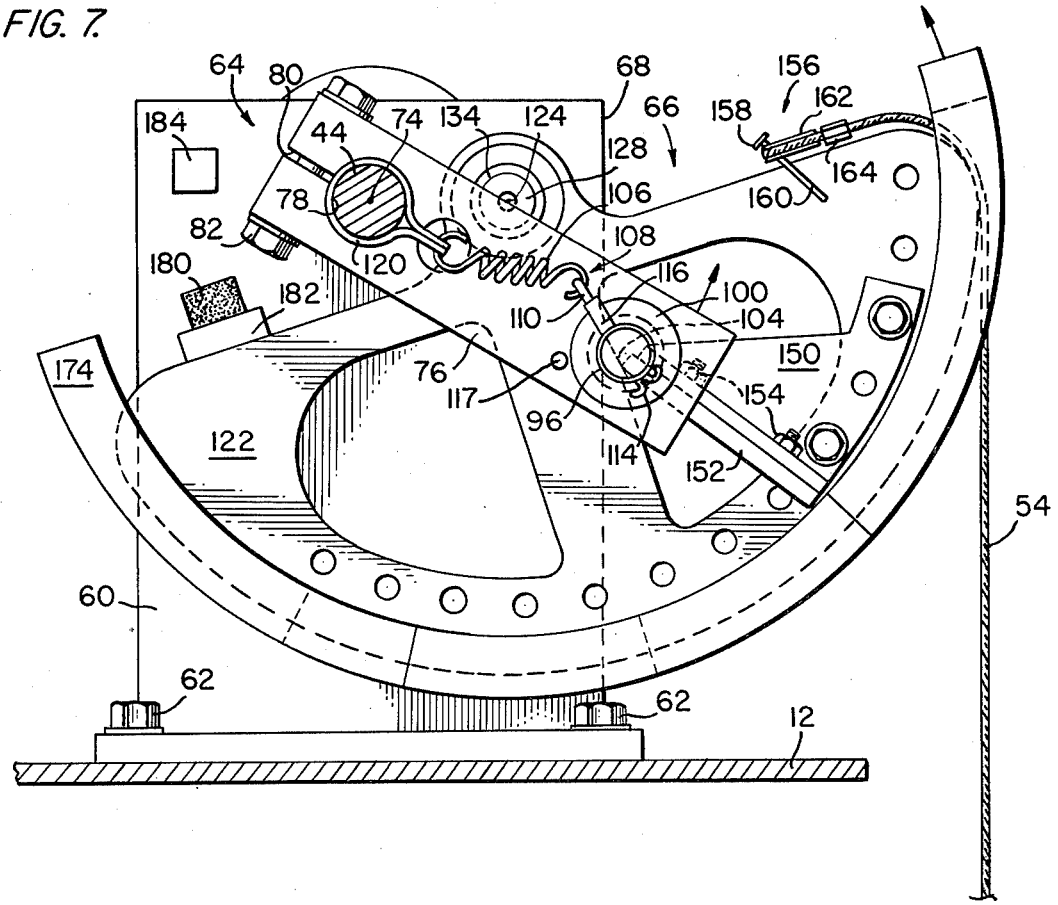
FIG. 7 is a view similar to that of FIG. 3, but taken along line 7—7 of FIG. 1, and showing a rapping mechanism with the driven assembly in an intermediate lifting position.

In FIG. 7, the driver 76 is at a rotational position whereby the follower member 150, and more particularly the bearing plate 152 thereof, has been engaged by the flat portion 104 of the follower guide 84 and pivoted counter-clockwise in the orientation illustrated to lift the associated one of the weights 52.

Although not specifically illustrated, it will be apparent that upon initial engagement the follower guide 84 rotates for parallel engagement of the flat portion 104 with the surface of the follower member 150. To accommodate continued parallel engagement of these surfaces, the follower guide 84 rotates with respect to the driver 76, accompanied by elongation of the spring 106. This rotation to maintain parallel engagement occurs due to the offset of the axes 74 and 124.

As rotation continues, the edge of the bearing plate 152 of the follower member 150 moves towards the edge of the follower guide flat portion 104, and rotation of the follower guide 84 past the point at which a parallel relationship is maintained results. This is illustrated in FIG. 7.

Figure 8:
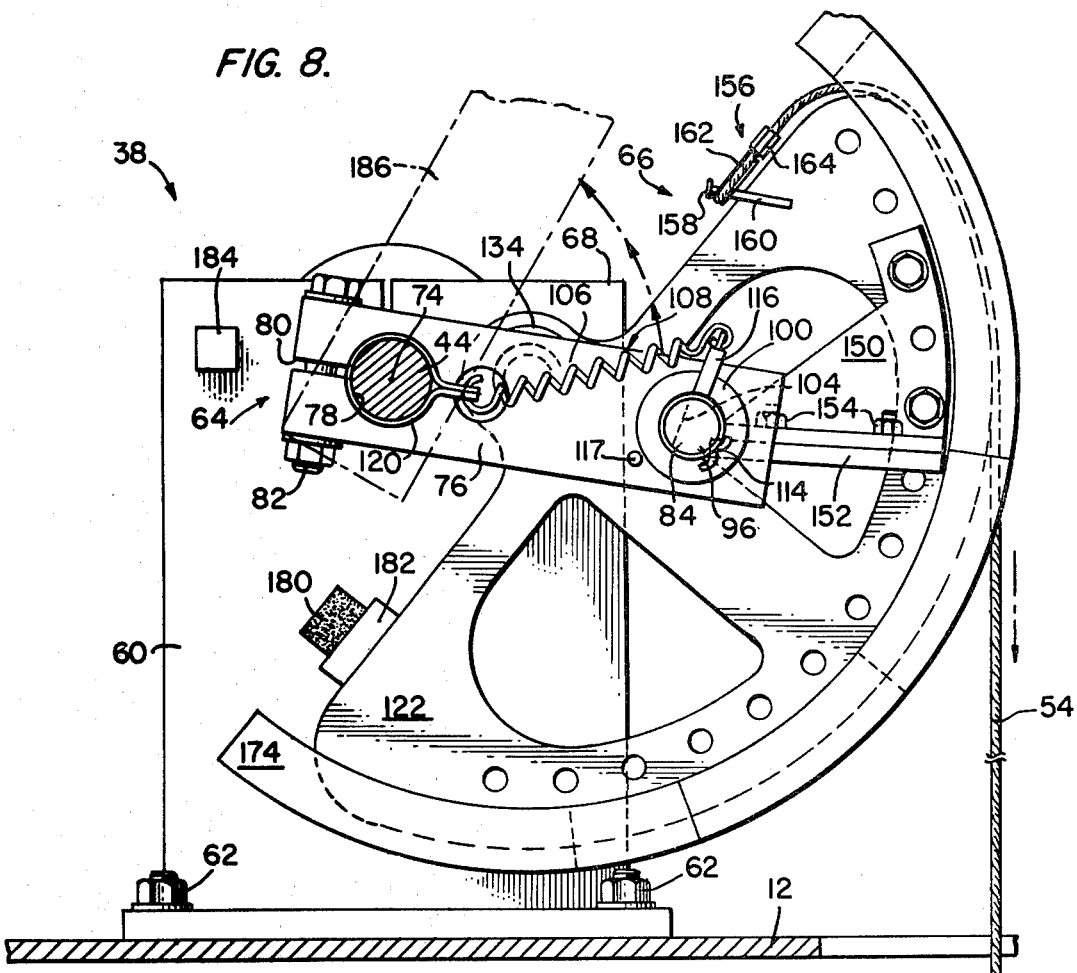
FIG. 8 is another view similar to that of FIG. 3, but taken along line 8—8 of FIG. 1, and showing a rapping mechanism with the driven assembly at a release position.

In FIG. 8, the driven assembly 66 has been carried to the point of release, and is just beginning its reverse (clockwise in the orientation illustrated in FIG. 18) rotation back towards the resting position illustrated in FIG. 3 at which the rubber stop 180 abuts the stop post 184.

In FIG. 8, it will be seen that at the point of release, the flat portion 104 of the follower guide 84 is no longer maintained in parallel relationship with the flat portion of the follower member 150. At this point, the concentration of force on the flat portion 104 has caused further pivotal rotation of the follower guide 84. Thus, it will be noted that as the surface 104 moves up the surface 152, when it passes the midpoint of surface 104, the reaction force of 152 on 84 causes clockwise rotation of 84 against the weak restoring spring 106. And the clearance between 104 (at 90°) and 152 effects a "trigger" or "quick" release of the driven member 66. Thus, the surface 104 does not linger at the corner of 152 to enhance the wear rate of the corner. Rebound of the follower guide 84 after release is imited by the cotter pin 110, and more particularly the collar 116, striking the stop pin 117.

As represented by a phantom line depiction 186 of the driver 76 in FIG. 8, the driving assembly 64, and more particularly the driver 76, continues to rotate after release of the driven assembly 66. During this portion of the rotation, the follower guide 84 pivotally returns to its resting position as seen in FIG. 3 under the urging of the spring 106. The particular resting position of the follower guide 84 is selected such that upon initial engagement of the follower guide flat portion 104 with the follower member 150, the respective flat surfaces thereof are approximately parallel.

It will be apparent that this operation depends on correct geometry. Specifically, the radial spacing of the follower guide 84 from the axis 74 is greater than the distance between the axes 74 and 124, and is less than the total of the distance between the axes 74 and 124 and the radial spacing of the follower member 150 from the axis 124. Accordingly, at the driven assembly 66 release position illustrated in FIG. 8, the follower guide 84 no longer reaches and enganges the follower member 150.

While specific embodiments of the invention have been illustrated and described herein, it is realized that modifications and changes will occur to those skilled in the art. It is therefore to be understood that the appended claims are intended to cover all such modifications and changes as fall within the true spirit and scope of the invention.

I claim:

1. An electrostatic precipitator rapping mechanism comprising:

a driving assembly mounted for rotation about a first axis and carrying a first engagement member radially spaced from the first axis;

a driven assembly mounted for pivotal movement on a second axis generally parallel to and offset from said first axis;

means attached to said driven assembly for lifting a weight as said driven assembly pivots in one direction towards a release position and for allowing the weight to fall to impact on a precipitator element as said driven assembly pivots in the other direction towards a resting position;

a second engagement member carried by said driven assembly and radially spaced from the second axis for engagement by said first engagement member; the radial space between said first engagement member and said first axis being greater than the distance between the axes and less than the total of the distance between the axes and the radial spacing of said second engagement member from said second axis such that said first engagement member engages said second engagement member at the driven assembly resting position and at positions intermediate the resting and release positions, and said engagement members disengage at the driven assembly release position, and wherein:

one of said engagement members comprises a fixed member having a surface portion extending generally radially with reference to the axis of its respective assembly and mounted securely to the respective assembly; and wherein said fixed member is adjustably mounted on the driven assembly.

2. A rapping mechanism according to claim 1, wherein:

the other of said engagement members comprises a member pivotally mounted to the respective assembly and including a surface portion which mates with said fixed member surface portion, pivotal movement of said pivotally mounted member accommodating conformal engagement of said engagement members through at least a portion of the range of pivotal movement of said driven assembly.

3. A rapping mechanism according to claim 2, wherein said surface portions are flat.

4. A rapping mechanism according to claim 2, which further comprises means for rotationally biasing said pivotally mounted member to a position where said surface portions are in approximately conformed engagement upon initial engagement.

5. A rapping mechanism according to claim 2, wherein:

said one of said engagement members is said second engagement member carried by said driven assembly and comprises a follower member; and said other of said engagement members is said first engagement member carried by said driving assembly and comprises a follower guide.

6. A rapping mechanism according to claim 1, wherein:

said second engagement member is a follower member comprising a flat portion extending generally radially with reference to the second axis and mounted securely to said driven assembly; and said first engagement member is a follower guide comprising a member pivotally mounted to said driving assembly and having a flat portion which engages said follower member flat portion, pivotal movement of said follower guide accommodating parallel engagement between said follower member flat portion and said follower guide flat portion through a portion of the range of movement of said driven assembly.

7. A rapping mechanism according to claim 6, wherein said driving assembly comprises means for rotationally biasing said follower guide to a position where said follower guide flat portion is approximately parallel to said follower member flat portion when said follower guide initially engages said follower guide at the driven assembly resting position.

8. A rapping mechanism according to claim 7, wherein said biasing means comprises a tension spring having one end attached to a radially spaced portion of said follower guide.

9. A rapping mechanism according to claim 1, wherein said means attached to said driven assembly for lifting a weight comprises:

a cable having one end attached to said driven assembly and the other end attached to the weight; and a cable guide defining a portion of the periphery of said driven assembly and receiving portions of said cable.

10. The rapping mechanism according to claim 1, wherein:

said engagement members are arranged such that adjustment of said one engagement member, clockwise toward the second engagement member, increases the lifting height of said weight.

11. A rapping mechanism according to claim 1, wherein:

said second engagement member is a follower member comprising a flat portion extending generally radially with reference to the second axis and mounted securely to said driven assembly; and said first engagement member is a follower guide comprising a member pivotally mounted to said driving assembly and having a flat portion which engages said follower member flat portion, pivotal movement of said follower guide accommodating parallel engagement between said follower member flat portion and said follower guide flat portion through a portion of the range of movement of said driven assembly, and accommodating line contact between said follower member flat portion and said follower guide flat portion immediately preceding the release position to thereby effect rapid release and reduce wear.

12. An electrostatic precipitator rapping mechanism comprising:

a driving assembly mounted for rotation about a first axis and carrying a follower guide radially spaced from the first axis;

a driven assembly mounted for pivotal movement on a second axis generally parallel to and offset from the first axis:

means for lifting a weight as said driven assembly pivots in one direction towards a release position and for allowing the weight to fall to impact on a precipitator element as said driven assembly pivots in the other direction towards a resting position, said means for lifting a weight including a cable having one end attached to said driven assembly and the other end attached to the weight, and a cable guide defining a portion of the periphery of said driven assembly and receiving portions of said cable;

a follower member mounted to said driven assembly and radially spaced from the second axis for engagement by said follower guide, said follower member including a flat portion extending generally radially with reference to the second axis:

said follower guide including a member pivotally mounted to said driving assembly and having a flat portion which engages said follower member flat portion, pivotal movement of said follower guide accommodating parallel engagement between said follower member flat portion and said follower guide flat portion through a portion of the range of movement of said driven assembly; and the radial space between said follower guide and said first axis being greater than the distance between the axes and less than the total of the distance between the axes and the radial spacing of said follower member from said second axis such that said follower guide engages said follower member at the driven assembly resting position and at positions intermediate the resting and release positions, and said follower guide and follower member disengage at the driven assembly release position.

13. An electrostatic precipitator rapping system comprising:

a rotating drive shaft; and a plurality of individual rapping mechanisms along said drive shaft, said drive shaft defining a first axis at each of said rapping mechanisms, and each of said rapping mechanisms including:

a driving assembly affixed to said drive shaft and rotating therewith and carrying a first engagement member radially spaced from the first axis;

a driven assembly mounted for pivotal movement on a second axis generally parallel to and offset from the first axis;

means attached to said driven assembly for lifting a weight as said driven assembly pivots in one direction towards a release position and for allowing the weight to fall to impact on a precipitator element as said driven assembly pivots in the other direction towards a resting position; and a second engagement member carried by said driven assembly and radially spaced from the second axis for engagement by said first engagement member;

the radial space between said first engagement member and said first axis being greater than the distance between the axes and less than the total of the distance between the axes and the radial spacing of said second engagement member from said second axis such that said first engagement member engages said second engagement member at the driven assembly resting position and at positions intermediate the resting and release positions, and said engagement members disengage at the driven assembly release position.

14. An electrostatic precipitator rapping system according to claim 13, wherein said individual rapping mechanism driving assemblies are affixed to said drive shaft at a plurality of angular positions such that said driven assemblies are released at a plurality of different times as said drive shaft rotates.

* * * * *